United States Patent [19]

Juhola

[11] 4,428,699

[45] Jan. 31, 1984

[54] PROCEDURE AND MEANS FOR PROVIDING A VERTICAL DRAIN IN THE BOTTOM OF A WATER BODY

[76] Inventor: Mauno O. Juhola, Lounaisväylä 2, 00200 Helsinki 20, Finland

[21] Appl. No.: 447,931

[22] Filed: Dec. 8, 1982

[30] Foreign Application Priority Data

Dec. 17, 1981 [FI] Finland ..... 814072

[51] Int. Cl.[3] ..... E02D 3/10; E21B 19/00

[52] U.S. Cl. ..... 405/50; 111/1; 405/36

[58] Field of Search ..... 405/36, 37, 50, 45–49; 254/29 R; 111/1–4

[56] References Cited

U.S. PATENT DOCUMENTS

| | | | |
|---|---|---|---|
| 3,300,987 | 1/1967 | Maeda | 405/50 |
| 3,891,186 | 6/1975 | Thorsell | 254/29 R |
| 3,898,940 | 8/1975 | Ede | 111/1 |
| 4,166,508 | 9/1979 | van den Berg | 405/36 X |

FOREIGN PATENT DOCUMENTS

| | | | |
|---|---|---|---|
| 2494323 | 1/1982 | France | 405/50 |
| 7707303 | 1/1979 | Netherlands | 405/50 |

*Primary Examiner*—Dennis L. Taylor

[57] ABSTRACT

Procedure and means for making a vertical drain in the bottom of a water body, e.g. a sea or lake, from a raft on the surface of the water body. A conveying member, carried by the raft movably in vertical direction, is brought to be close to the bottom of the water body. A push tube, carried by the conveying member movably in vertical direction, is pushed into the soil layer on the bottom of the water body to desired depth, whereby the push tube carries along the prefabricated drain, provided with an anchor on its lower end, located therewith in. Thereafter, the push tube is pulled up, the strip drain remaining in its place in the soil layer by the aid of the anchor. The aim of the invention is to reduce the consumption of prefabricated drain material, to reduce the time consumed in the operation and to reduce energy consumption. The invention teaches to pull the push tube up above the lower end of the conveying member. Another anchor is affixed to the prefabricated drain by the aid of an affixing means, located on the lower end of the conveying member.

8 Claims, 5 Drawing Figures

PROCEDURE AND MEANS FOR PROVIDING A VERTICAL DRAIN IN THE BOTTOM OF A WATER BODY

Figure 2:
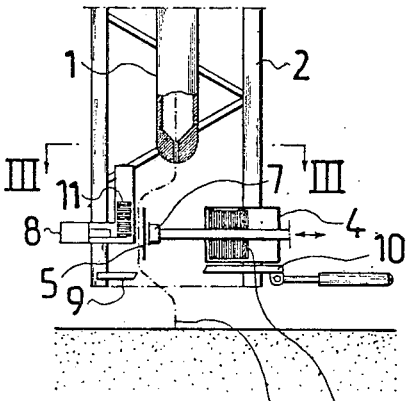

The present invention is applied when a clay or mud layer with a thickness which may be tens of meters on the bottom of sea or lake is dewatered and drained by vertical draining. Vertical draining is necessary when a particular site on the sea or lake bottom is designed to be filled e.g. for building a road, railway or even an air field. If the soft, compressible clay or mud layer is not drained vertically before filling, it takes tens of years before the compressible layers are settled by effect of the filling and other loads applied on top of them. By draining vertically, the settling can be accelerated to take place in a year or two, or even in a few months' time, depending on the conditions on the bottom and the spacing of the vertical drains. The amount of the settlements may be up to several meters depending on the bottom conditions and loads.

For purposes of vertical draining various prefabricated drains have been designed, e.g. drains made of profiled, about 10 cm broad plastic strip material and of water-permeable, porous paper or other similar filtering material wound around the strip. Water drains from the soil through the porous paper into channels in the prefabricated drain, wherefrom it ascends and escapes into the water body.

When nowadays prefabricated drains are employed for vertical draining of clay and mud layers, the method is to extend the strip drain from the solid bottom soil through the clay layer up to the water surface where it is cut off. Depending on the bottom conditions, and the aims, strip drains of this type are disposed with a suitable spacing, for instance at intervals of one to two meters on the area to be strengthened.

The procedure of prior art presents several remarkable drawbacks. The consumption of strip drains is high, because the drains are unnecessarily extended from the bottom of the water body to the surface, which distance may be tens of meters. The procedure is slow, because the members by which the strip drain is pushed into the clay or mud layer on the bottom have to be lifted up all the way to the surface of the water body after making each vertical drain. In addition, this activity consumes a lot of energy.

The object of the present invention is to develop further the procedure of prior art. Therefore, the object of the invention is a procedure for providing a vertical drain in the bottom of a sea or lake working from a raft on the surface of the water body, in which procedure a conveying member, supported on the raft movably in vertical direction, is lowered to a depth close to the bottom of the water body; a push tube, supported by the conveying member movably in vertical direction, is pushed into the soil layer on the bottom of the water body to desired depth, whereby the push tube carries with it the prefabricated drain, provided with an anchor on its lower end, whereafter the push tube is pulled up, while the prefabricated drain remains in its place in the soil layer with the aid of the anchor. The invention is characterized in that the push tube is pulled up to a height above the lower end of the conveying member, that another anchor is affixed to the strip drain by the aid of a fastening means on the lower end of the conveying member.

It is thus understood that according to the invention the conveying member and the push tube are not at all lifted to the surface of the waterbody, instead of which the lower end of the conveying member remains on the same level near the bottom of the water body, while different vertical drains are being made. It is only the push tube that is lifted up above the lower end of the conveying member. In the procedure of the invention, the needed quantity of prefabricated drain material (which usually comes in reels) is reduced. Let it be assumed, for instance, that the extent of the area to vertically drained is 10 hectares, that the prefabricated drains are spaced at 1.5 m, and that from the length of each strip drain can be saved 10 m, then the total saving of prefabricated drain material is 440,000 meters. One advantageous embodiment of the procedure of the invention is characterized in that the prefabricated drain is cut off at a point underneath the anchor after the anchor has been fastened. When the strip drain is cut after fixing the anchor, the strip drain remains better in its proper position during the fixing of the anchor. Were the anchor affixed to the prefabricated drain with lateral displacement, mud could enter the push tube, which would greatly derange the function. It is also possible, of course, to cut the prefabricated drain before fixing the anchor.

According to another advantageous application of the present invention, the prefabricated drain is after fixing the anchor pulled upwards so that the anchor abuts tightly on the lower end of the push tube. This measure, too, aims at closing the aperture on the lower end of the push tube tightly and to ensure that the anchor will be properly pushed into the clay or mud layer. The same effect is obtained, if after fixing the anchor the prefabricated drain is held back so that the anchor is held in abutment against the lower end of the push tube.

The object of the invention is furthermore a means for carrying out the procedure comprising a raft with a conveying member, supported movably by this in vertical direction, within the latter being placed the prefabricated drain which is to be introduced in the soil layer on the bottom of the water body, of which the lower end is provided with an anchor. The means is characterized in that the lower end of the conveying member carries a means for fixing the anchors and therebelow a means for cutting the prefabricated drain.

Figure 1:
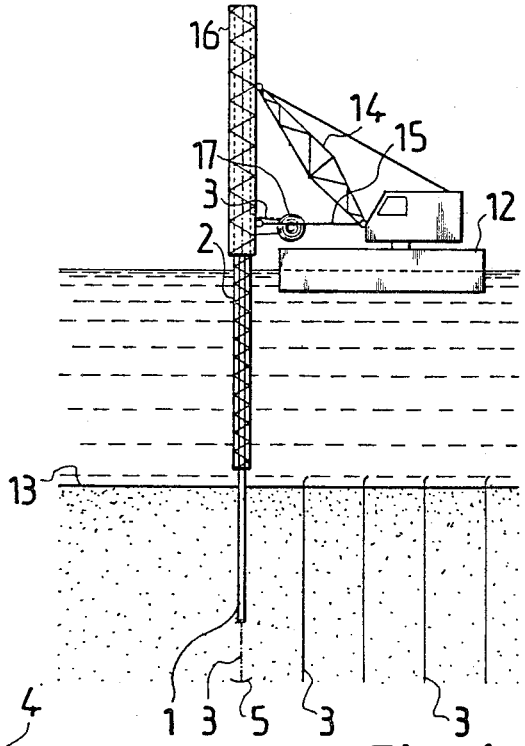

The invention is in the following described with the aid of an example, referring to the attached drawings, wherein FIG. 1 presents a means for making vertical drains in the bottom of a water body.

FIG. 2 presents the lower end of the conveying member in vertical longitudinal section.

Figure 3:
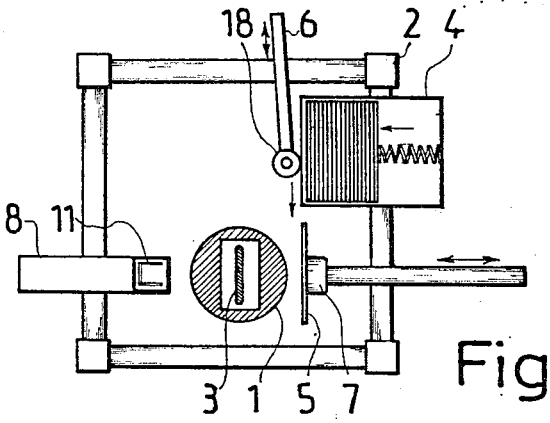

FIG. 3 presents the section along the line III—III in FIG. 2.

Figure 4:
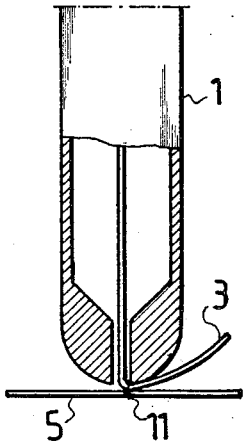

FIG. 4 presents the lower end of the push tube before its entering the clay or mud layer on the bottom of the water body.

Figure 5:
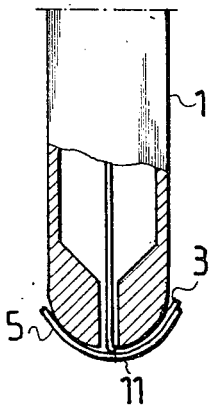

FIG. 5 presents the lower end of the push tube after it has entered the clay or mud layer.

In FIG. 1, reference numeral 12 refers to a raft floating on the surface of the water body. The raft may also be supported on the bottom 13 of the water body. To the raft 12 has been connected a vertical guiding boom by means of articulated booms 14, 15, which guide boom 16 can be moved and tilted in relation to the raft 12. On the guiding boom has been supported, movably in vertical direction, a conveying member 2, whereon in turn has been supported, movably in vertical direction, a push tube 1. On the guiding boom 16 has been rotatably carried a stock reel 17 of prefabricated strip drain material 3. In the position of FIG. 1, the push tube 1 has carried the prefabricated drain 3 into the soil layer on the bottom of the water body, wherein the prefabricated drain 3 has become anchored by means of the anchor 5, and the push tube 1 is just now returned to its upper position.

FIGS. 2 and 3 present the lower end of the conveying member 2. The push tube 1 has been raised above the lower end of the conveying member 2. The lower end of the conveying member carries a means for fixing the anchors 5. It consists of a stock magazine cassette 4 containing plate-shaped anchors. Reference numeral 6 refers to a feeding member which from the cassette 4 takes one anchor at a time and feeds it to be in front of the feeding pad 7. The feeding pad 7 in turn pushes the anchor 5 against the prefabricated drain 3 and further against the locking means 8, here a stapler. The stapler 8 is triggered by the pressure from the feeding pad 7, whereby the staple 11 is forced through the prefabricated drain 3 and the anchor 5, and the ends of the staple 11 are bent against the pad 7 behind the anchor 5 and fix the prefabricated drain 3 and the anchor 5 together. FIG. 2 presents the position in which the feeding pad 7 has pushed the anchor 5 and the prefabricated drain 5 close to the stapler. FIG. 3 presents the position in which the feeding member 6 has fed an anchor 5 from the cassette to be in front of the feeding pad 7. The feeding member 6 carries a feeding roller 18. This can be replaced e.g. by a suitable friction element, a magnet or suction cup or equivalent. The anchor 5 remains in contact with the feeding pad 7 e.g. with the aid of a magnet.

Underneath the fastening device of the anchors 5 is located the prefabricated drain cut-off means consisting of a moving cut-off blade 10 and a stationary counterblade 9.

From the position depicted in FIG. 1 the means functions in that the push tube 1 ascends above the lower end of the conveying member 2, in other words to the position of FIG. 2. The conveying member 2 remains in its place, that is, its lower end is located near the bottom 13 of the water body. The feeding pad 7 pushes the anchor 5 in front of it and the prefabricated drain 3 against the stapler 8, whereby one or more staples 11 connect the prefabricated drain 3 and the anchor 5 together. The feeding pad 7 returns to its initial position, that is, to the position of FIG. 3, whereafter the feeding member 6 pushes another anchor 5 to be in front of the feeding pad 7. The cut-off blade 10 and the counterblade 9 cut the prefabricated drain 3. The push tube 1 starts moving downwards, while the prefabricated drain 3 is being retained so that the anchor 5 is moved to the position shown in FIG. 4, whereby it closes the aperture at the lower end of the push tube 1. During the operations just described, the entity consisting of the guiding boom 16, the conveying member 2 and the push tube 1 has laterally moved to another site, that is to say, approximately one or two meters from the previous position. Thereafter the push tube 1 enters the soil layer on the bottom 13 of the water body, whereby the anchor 5 is bent to the position presented in FIG. 5. After the push tube 1 has reached the desired depth it is pulled up, the anchor 5 and the prefabricated drain 3 remaining in the soil layer. After the steps stated, work continues in the manner disclosed the in the foregoing.

It is clear to a person skilled in the art that diverse embodiments of the invention may vary within the scope of the claims stated below. The drawings show the push tube 1 within the conveying member 2, but it may equally be located outside the conveying member. As shown in FIGS. 2 and 3, the anchors 5 are picked from a stock cassette 4. Instead, the anchors 5 may be taken from a strip reel, in which connection the strips can be provided with transverse weakening lines so that the anchors are easily detachable from the strip.

Instead of using staples 11, e.g. self-tapping screws can be used to affix the anchor 5 to the prefabricated drain 3. The staples 11, self tapping screws or other equivalent means may be arranged to be supplied from the side of the feeding pad 7 as well.

Instead of using particular fixing elements 11, the anchor 5 may be fastened to the prefabricated drain 3 in that the margins of the anchor 5 are bent behind the prefabricated drain 3. This is easily arrangeable by means of suitable guiding members.

It goes without saying that all functions described in the foregoing are made to take place automatically.

I claim:

1. Improvement in a procedure for making a vertical drain in the bottom of a water body such as a sea or lake from a raft on the surface of the water body, wherein a conveying member, carried on the raft movably in vertical direction, is brought to be close to the bottom of the water body, a push tube supported by the conveying member movably in vertical direction is pushed into the soil layer on the bottom of the water body to desired depth, whereby the push tube carries along a prefabricated drain, provided with an anchor at its lower end, whereafter the push tube is pulled up, while the prefabricated drain remains in its place in the soil layer with the aid of the anchor, wherein the improvement comprises that the push tube is pulled up to be above the lower end of the conveying member, that another anchor is affixed to the prefabricated drain by the aid of a fixing means located on the lower end of the conveying member.

2. Procedure according to claim 1, characterized in that the prefabricated drain is cut, after fixing the anchor, at a point below the anchor.

3. Procedure according to claim 1, characterized in that after affixing the anchor the prefabricated drain is pulled upwards so that the anchor settles tightly against the lower end of the push tube.

4. Procedure according to claim 1, characterized in that after affixing the anchor the prefabricated drain is retained, simultaneously pushing the push tube downwards so that the anchor settles tightly against the lower end of the push tube.

5. Means for carrying out a procedure according to any one of the preceding claims comprising a raft with a conveying member supported to be vertically movable and with a push tube, supported by the latter to be movable in vertical direction and inside which is located the prefabricated drain to be conveyed into the soil layer on the bottom of the water body, of which the lower end is provided with an anchor, characterized in that the conveying member on its lower end carries a fixing means for the anchors, and therebelow a cutting means for cutting the prefabricated drain.

6. Means according to claim 5, characterized in that the means for affixing anchors consists of an anchor magazine, wherefrom a feeding member picks one anchor at a time and feeds it to be in front of the feeding pad, which in turn pushes the anchor against the prefabricated drain and further against a locking means to the purpose of affixing the anchor to the prefabricated drain.

7. Means according to claim 6, characterized in that the anchors are plate-like and located in a cassette-type anchor magazine.

8. Means according to claim 6, characterized in that the locking means consists of a stapler, which is triggered by effect of pressure from the feeding pad.

* * * * *